US008210383B1

(12) United States Patent
Devita

(10) Patent No.: US 8,210,383 B1
(45) Date of Patent: Jul. 3, 2012

(54) TRASH DUMPSTER AND COVERING COMBINATION ASSEMBLY

(76) Inventor: Anthony M. Devita, Hawthorne, NJ (US)

( * ) Notice: Subject to any disclaimer, the term of this patent is extended or adjusted under 35 U.S.C. 154(b) by 790 days.

(21) Appl. No.: 12/247,015

(22) Filed: Oct. 7, 2008

(51) Int. Cl.
*B65D 45/00* (2006.01)

(52) U.S. Cl. ..... 220/315; 220/908; 220/331; 220/345.2

(58) Field of Classification Search ..... 220/264, 220/324, 326, 329, 331, 345, 908, 345.1, 220/345.2, 315, 350; 206/216; 414/411
See application file for complete search history.

(56) References Cited

U.S. PATENT DOCUMENTS 1,481,194 A * 1/1924 Fischer ..... 220/503
4,726,616 A * 2/1988 Schmidt ..... 294/68.2
4,934,562 A 6/1990 Early et al.
4,955,501 A 9/1990 Hodge
5,167,341 A 12/1992 Morton et al.
5,533,643 A * 7/1996 Kruzick ..... 220/812
6,732,883 B2 5/2004 Petzitillo, Jr. et al.
7,234,327 B2 * 6/2007 Howes ..... 70/159
D549,917 S 8/2007 Kassigkeit
7,278,546 B2 * 10/2007 Williams ..... 220/254.2
2006/0006177 A1 * 1/2006 Clark et al. ..... 220/200

* cited by examiner

*Primary Examiner* — Mickey Yu
*Assistant Examiner* — Kareen Rush

(57) ABSTRACT

A trash dumpster and covering combination assembly includes a container with a bottom wall and a perimeter wall that is attached to and extends upwardly from the bottom wall. The perimeter wall has an upper edge defining an opening extending into the container. The perimeter wall includes a rear wall, a first lateral wall, a second lateral wall, and a front wall. A pair of guides is provided. Each of the guides is attached to the upper edge of the perimeter wall and each of the first and second lateral walls has one of the guides attached thereto. A cover is slidably mounted to the container by the guides. The cover is positionable in a closed position extending from the back wall to the front wall or slid toward the back wall to expose the opening.

1 Claim, 4 Drawing Sheets

TRASH DUMPSTER AND COVERING COMBINATION ASSEMBLY

BACKGROUND OF THE INVENTION

Field of the Invention

The present invention relates to trash dumpster devices and more particularly pertains to a new trash dumpster device for receiving rubbish or scrap and which can be covered to prevent unauthorized use of the dumpster device.

SUMMARY OF THE INVENTION

The present invention meets the needs presented above by generally comprising a container that includes a bottom wall and a perimeter wall which is attached to and extends upwardly from the bottom wall. The perimeter wall has an upper edge defining an opening extending into the container. The perimeter wall includes a rear wall, a first lateral wall, a second lateral wall, and a front wall. A pair of guides is provided. Each of the guides is attached to the upper edge of the perimeter wall and each of the first and second lateral walls has one of the guides attached thereto. A cover is slidably mounted to the container by the guides. The cover is positionable in a closed position extending from the back wall to the front wall or slid toward the back wall to expose the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
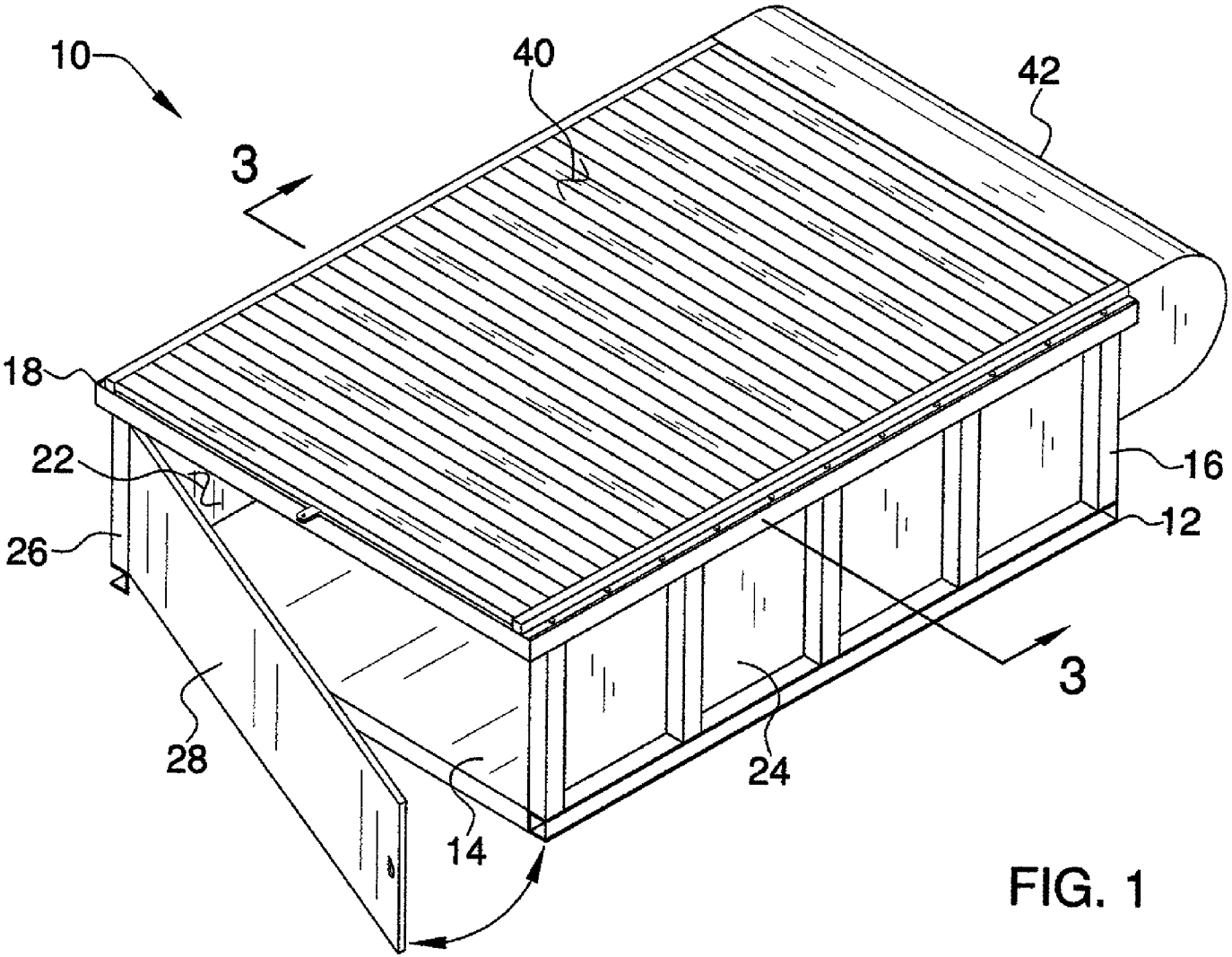
FIG. 1 is a top perspective view of a trash dumpster and covering combination assembly according to the present invention.
Figure 2:
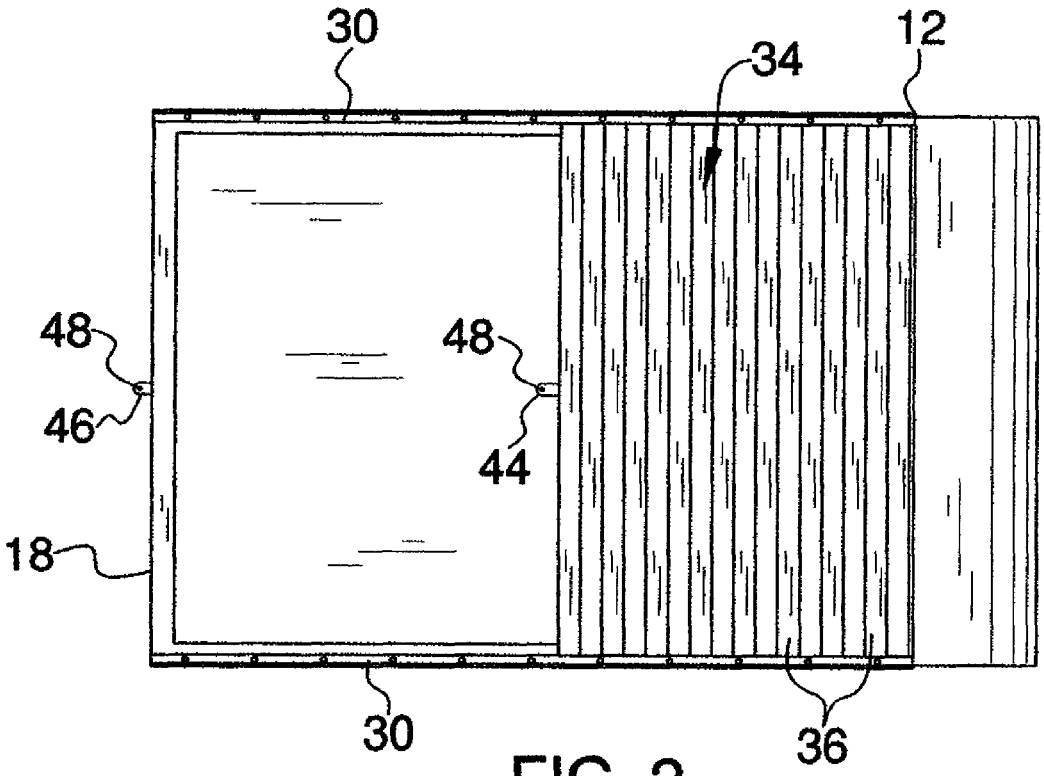
FIG. 2 is a top view of the present invention.
Figure 3:
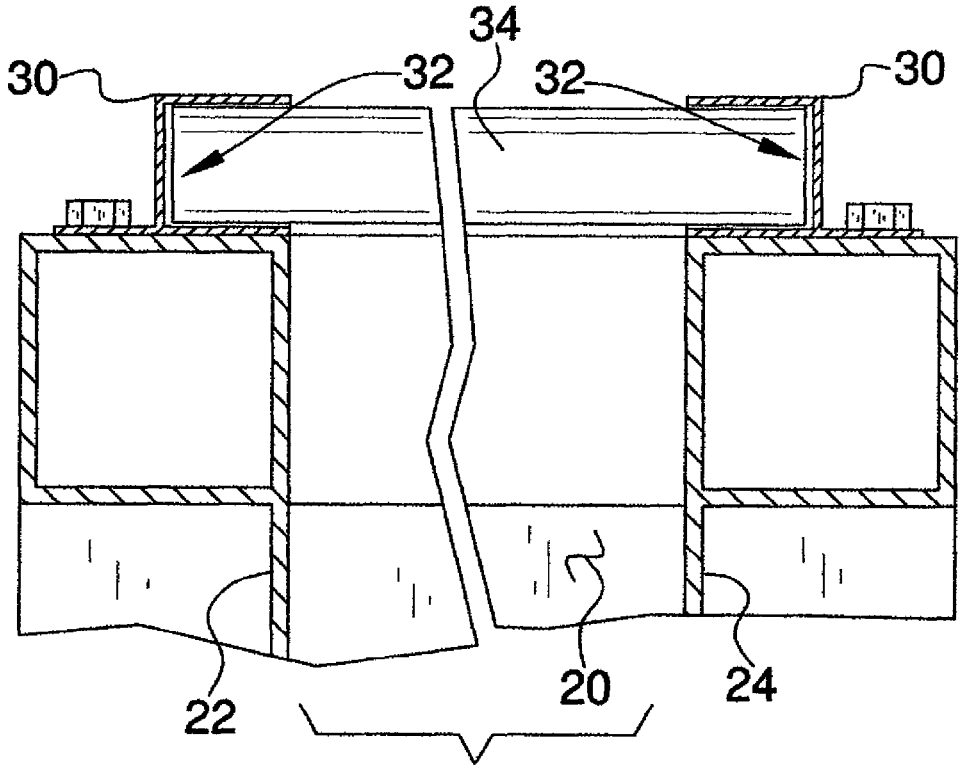
FIG. 3 is a broken cross-sectional view taken along line 3-3 of FIG. 1 of the present invention.

With reference now to the drawings, and in particular to FIGS. 1 through 5 thereof, a new trash dumpster device embodying the principles and concepts of the present invention and generally designated by the reference numeral 10 will be described.

As best illustrated in FIGS. 1 through 5, the trash dumpster and covering combination assembly 10 generally comprises a container 12 that includes a bottom wall 14 and a perimeter wall 16 that is attached to and extends upwardly from the bottom wall 14. The perimeter wall 16 has an upper edge 18 defining an opening extending into the container 12. The perimeter wall 16 includes a rear wall 20, a first lateral wall 22, a second lateral wall 24, and a front wall 26. The container 12 has a height equal to at least 4 feet and a length and width each greater than 4 feet.

A door 28 is positioned in the front wall 26 and is hingedly coupled to the container 12 to allow access to an interior of the container 12 through the perimeter wall 16. While the container 12 will be used as a trash bin itself, the door 28 can be used so that smaller trash bins may be positioned within the container 12.

Figure 4:
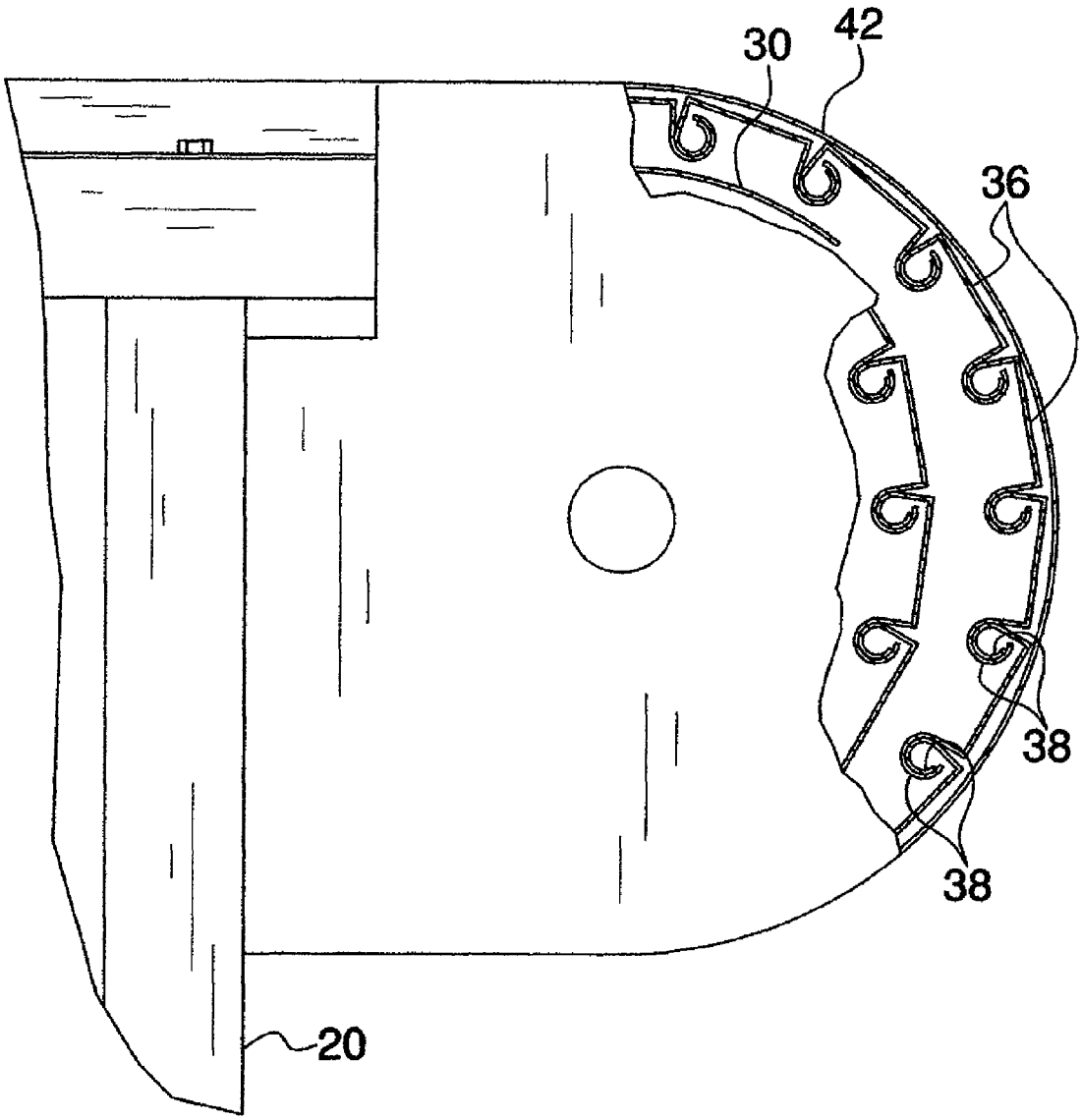
FIG. 4 is a side broken view of the present invention.
Figure 5:
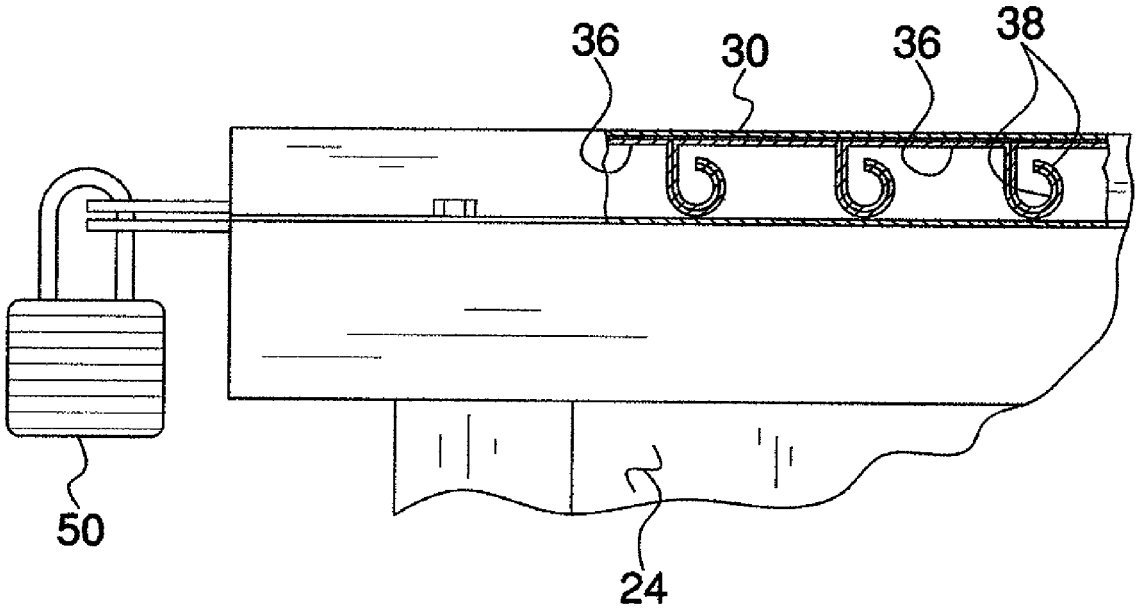
FIG. 5 is a side broken view of the present invention.

A pair of guides 30 is provided. Each of the guides 30 is attached to the upper edge 18 of the perimeter wall 16 and each of the first 22 and second 24 lateral walls has one of the guides 30 attached thereto. The guides 30 extend between the front 26 and back 20 walls and form elongated openings 32 facing each other. A cover 34 is slidably mounted to the container 12 by the guides 30. The cover 34 is positionable in a closed position extending from the back wall 20 to the front wall 26 or slid toward the back wall 20 to expose the opening defined by the upper edge 18. The cover 34 includes a plurality of elongated plates 36 extending between the guides 30 and positioned in the elongated openings 32. The plates 36 are hingedly coupled together. The plates 36 each include a pair of semi-cylindrical connecting members 38 that are interlocked with each other as shown in FIG. 5. The connecting members 38 allow the plates 36 to pivot with respect to each other as shown in FIG. 4 while their cylindrical shapes allows them to easily slide along the guides 18 and along a top side 40 of the cover 34 when the cover 34 is being rolled up as is shown in FIG. 4.

A housing 42 is attached to the back wall. The housing engages the guides 30 and receives the cover 34 when the cover 34 is slid toward the back wall 20 and off of the container 12. The housing 42 has an arcuate shape that causes the cover to roll upon itself.

A first panel 44 is attached to the cover 34 and a second panel 46 is attached to the front wall 26. The first 44 and second 46 panels each have an aperture 48 extending therethrough. The apertures 48 in the first 44 and second 46 panels are alignable with each other when the cover 34 is in the closed position. A lock 50 is extendable through the apertures 48 to secure the cover 34 in the closed position.

In use, the container 12 is used in a conventional manner to receive trash or building material scrap in a conventional manner. However, the cover 34 prevents unauthorized use of the container 12 by others attempting to use the container 12 to discard rubbish.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trash dumpster assembly comprising:

a container including a bottom wall and a perimeter wall being attached to and extending upwardly from said bottom wall, said perimeter wall having an upper edge defining an opening extending into said container, said perimeter wall including a rear wall, a first lateral wall, a second lateral wall, and a front wall;

a door being positioned in said front wall and being hingedly coupled to said container to allow access to an interior of said container through said perimeter wall;

a pair of guides, each of said guides being attached to said upper edge of said perimeter wall, each of said first and second lateral walls having one of said guides attached thereto, said guides extending between said front and back walls, said guides forming elongated openings facing each other;

a cover being slidably mounted to said container by said guides, said cover being positionable in a closed position extending from said back wall to said front wall or slid toward said back wall to expose said opening, said cover including a plurality of elongated plates extending between said guides, each of said plates being hingedly coupled together;

a housing being attached to said back wall, said housing engaging said guides and receiving said cover when said cover is slid toward said back wall and off of said container, said housing having an arcuate shape; and a first panel being attached to said cover and a second panel being attached to said front wall, said first and second panels each having an aperture extending therethrough, said apertures in said first and second panels being alignable with each other when said cover is in said closed position, wherein a lock is extendable through said apertures to secure said cover in said closed position.

* * * * *